US007946851B2

(12) United States Patent
Howard

(10) Patent No.: US 7,946,851 B2
(45) Date of Patent: May 24, 2011

(54) ALTERNATING CAGE COUPLER

(75) Inventor: Michael Howard, Dracut, MA (US)

(73) Assignee: Diamond-Roltran, LLC, Littleton, MA (US)

( * ) Notice: Subject to any disclaimer, the term of this patent is extended or adjusted under 35 U.S.C. 154(b) by 0 days.

(21) Appl. No.: 12/474,609

(22) Filed: May 29, 2009

(65) Prior Publication Data

US 2009/0298302 A1 Dec. 3, 2009

Related U.S. Application Data

(60) Provisional application No. 61/058,090, filed on Jun. 2, 2008.

(51) Int. Cl.
*H01R 39/00* (2006.01)

(52) U.S. Cl. ..... 439/13; 439/15

(58) Field of Classification Search ..... 439/13, 439/15

See application file for complete search history.

(56) References Cited

U.S. PATENT DOCUMENTS

| | | | | |
|---|---|---|---|---|
| 3,771,106 | A | 11/1973 | Matsumoto et al. | |
| 4,372,633 | A * | 2/1983 | Allen et al. | 439/17 |
| 4,714,819 | A | 12/1987 | Yamashita | |
| RE32,805 | E | 12/1988 | Engelmore et al. | |
| 4,850,880 | A | 7/1989 | Zayat, Jr. et al. | |
| 4,881,153 | A * | 11/1989 | Scott | 362/500 |
| 5,009,604 | A * | 4/1991 | Plocek et al. | 439/15 |
| 5,348,481 | A | 9/1994 | Ortiz | |
| 5,772,146 | A * | 6/1998 | Kawamoto et al. | 242/388 |
| 5,775,920 | A * | 7/1998 | Henderson | 439/15 |
| 5,809,136 | A | 9/1998 | Turner | |
| 5,851,120 | A * | 12/1998 | Sobhani | 439/17 |
| 5,865,629 | A | 2/1999 | Bernardini | |
| 6,331,117 | B1 * | 12/2001 | Brundage | 439/21 |
| 6,612,847 | B2 * | 9/2003 | Canizales, Jr. | 439/17 |
| 6,612,849 | B1 | 9/2003 | Scott | |
| 6,658,729 | B2 | 12/2003 | Brodsky | |
| 6,749,210 | B2 | 6/2004 | Tanaka | |
| 6,921,269 | B2 * | 7/2005 | Johnson et al. | 439/13 |
| 2002/0111047 | A1 | 8/2002 | Jacobson | |
| 2006/0028088 | A1 | 2/2006 | McFarland | |
| 2006/0264070 | A1 | 11/2006 | Day et al. | |
| 2008/0085613 | A1 | 4/2008 | Ju | |

FOREIGN PATENT DOCUMENTS

| | | | |
|---|---|---|---|
| SU | 1019529 | A1 | 5/1983 |
| WO | 0154251 | A1 | 7/2001 |

* cited by examiner

*Primary Examiner* — Truc T Nguyen
(74) *Attorney, Agent, or Firm* — Hayes Soloway P.C.

(57) ABSTRACT

A full-rotational conductor assembly includes a pair of coaxial electrically conductive members having complementary tracks, relatively rotatable about a common axis. A plurality of electrically conductive coupler halves located between and engaging the tracks enable electrical connection between the tracks of the conductive members. A cage is connected to each of the coupler halves and substantially located between the complimentary tracks.

16 Claims, 5 Drawing Sheets

ALTERNATING CAGE COUPLER

CROSS REFERENCE TO RELATED APPLICATION

This application claims priority to copending U.S. Application entitled, "Alternating Cage Coupler," having Ser. No. 61/058,090 filed Jun. 2, 2008, which is entirely incorporated herein by reference.

STATEMENT REGARDING FEDERALLY SPONSORED RESEARCH OR DEVELOPMENT

This disclosure was made in part with Government support under contract number N68335-07-C-0269 awarded by the Naval Air Warfare Center. The Government may have certain rights in the disclosure.

FIELD OF THE DISCLOSURE

The present disclosure relates to an electrical connector between relatively rotating elements. More specifically, the present disclosure is a rolling electrical transfer to improved transfer coupling members between the rotating and the stationary components.

BACKGROUND OF THE DISCLOSURE

The present disclosure relates to an electrical connector between relatively rotating elements. Electrical equipment such as radar and ship antennas have a need to transmit power and data between stationary equipment and relatively rotating equipment. Electrical connectors that can accommodate constant rotation are needed for these types of applications. Many such electrical connectors exist, but with a variety of deficiencies.

Slip rings have a long history of applications for the transfer of electrical signals and power across a rotating interface. The sliding action between the brush and the ring results in significant drag torque and wear debris. Although a number of improvement patents have been granted for slip rings sets, which have improved brush designs such as bundles of conductive fibers, additional improvements are still required. These include an elimination of trades of such parameters as brush pressure and contact area on electrical noise resistance, wear, life, and torque, and sensitivities of brush and ring material on air, fluid and vacuum environments. Maintainability costs related to brush seizure and failure are also excessive.

Rolling electrical conductor assemblies offer performance and life improvements. These concepts, however, are not broadly new and have heretofore been proposed for use in place of the more conventional slip ring and brush assemblies. Early rolling types of conductor assemblies exist, such as those disclosed in U.S. Pat. Nos. 2,467,758 and 3,259,727. U.S. Pat. No. 3,259,727 describes a coil spring coupler design to electrically connect the stationary and the rotary components of the transfer device. This multi-turn spring configuration is more economical to fabricate than a single hoop but imposes increased stress levels for a given preload. A rolling electrical conductor assembly that achieves an economical fabrication benefit without imposing greater stress is needed.

Important improvements have since been developed as disclosed by U.S. Pat. Nos. 4,068,909; 4,098,546; 4,141,139; 4,335,927; 4,372,633 and 4,650,226 which disclose rolling electrical interface configurations for both low level signals and for power. These configurations all use band shaped cylindrical flexible couplers, which are captured in concave grooves in two concentric tracks to electrically connect the rings. The couplers have compliance so as to be preloaded between the two rings. These second-generation transfer configurations provide longer life and near absence of alignment and preload sensitivities, wear debris and rotational torque and greater transfer current capacity. They tend to be relatively expensive to design and manufacture, however, without restricting the potential performance and life benefits. Additional improvements are still required, therefore, to meet the ever-increasing demands of the industry. New improvements are required in rolling electrical transfer components to provide reliable operation for hundreds of millions of bi-directional revolutions without producing significant wear debris, to transfer higher steady-state and surge currents, to eliminate electrical transfer sensitivities to externally induced contaminants and to reduce manufacturing costs.

U.S. Pat. Nos. 5,009,604 and 5,429,508 describe coupler designs for transferring electrical signals between stationary sensors and rotatable steering wheel mounted components such as air bags. One of these coupler designs, which electrically couples the stationary and rotatable component, is of a hoop shape and is rolled out of sheet stock with an overlapping region. Another uses resilient spheres, which roll in grooved tracks in the stationary and rotational components. The hoop configuration is cost effective and allows thicker material to be used which is advantageous, but tests in grooved tracks have demonstrated a speed limit of only a few hundred RPM because of mechanical discontinuity at the over-lap region. The speed limit is lower in the rotation direction, which causes the over-lap section to advance into the contact interfaces. Debris is generated as the ends of the over-lapped region bi-directionally slide against one another while the radial load moves around the rolling coupler, which reduces its operational life. Examination of couplers after test has identified the source of the speed limit, wear and debris as variations of roundness at the contact diameter and associated preload perturbations during operation. The spherical couplers require multiple components per track, which necessitates the addition of a guide plate assembly, and associated sliding induced component wear.

In all of the listed patents and prior art, the coupler, is predominantly a flexible member, which rides in, and is captured in, the curved tracks in the two conductive members. For those cases where the coupler is not flexible, the fixed and/or rotating members provide the necessary compliance since the coupler is radially preloaded in the tracks. In all of the cited configurations the member-to-member radial annulus space and the radial variations in the track-to-track spacing are accommodated by the radial compliance of the coupler. This rolling deflection results in stress cycling of the coupler as the member and coupler rotates. The configuration is such as to result in more coupler cycles than member rotations. The effect of stress cycling on coupler fatigue life must be carefully considered for each design, which factors into the fatigue characteristics of the coupler material. This requires a knowledge of the material heat treat and process work hardening effects. This information is usually not available at the design stage of the coupler and must be determined throughout.

The roll ring configuration of U.S. Pat. No. 4,372,633 provides increased current transfer capacity by way of increased numbers of couplers, which couple the members. This configuration also uses idlers between the couplers to avoid rubbing friction and wear between adjacent couplers. This configuration also provides guide rails mounted to the inner member to assure that all of the track and coupler interfaces are in rolling contact. The band shaped coupler configuration is costly to fabricate, inspect and plate. Coupler designs that provide the necessary compliance for fitting and preloading between the tracks are thin-walled, hence limiting the transfer current per coupler and the contact areas with the tracks. The contact interfaces exhibit low wear because of the rolling action and the low preload required. Unfortunately, the parameters that lead to low wear also exhibit greater sensitivity to contaminants at the interfaces, which can result in a variation of electrical transfer resistance. This problem specifically affects operations in severe contamination environments such as encountered for helicopter mastheads and tank turrets. The simultaneous requirements of appropriate assembled deflection, current density, contact preload and fatigue life complicates and compromises the design process and results in a flexure wall which is usually thin, on the order of 0.1 mm or so. Additionally, since the coupler walls are thin, it is often not possible to provide proper edge profiles. The operational life and performance is related to this profile. Therefore, it is important to reducing interface sliding and current density to acceptable levels. The thin wall coupler is also difficult and costly to fabricate because of its compliance.

The application of this multi-coupler transfer design is also size limited since the configuration requires that the annulus space between the two concentric rings be filled with a full complement of couplers and idlers. This design is not cost effective because it contains non-utilized current capacity. Improved coupler design configurations are required which have reduced fabrication costs and allow the use of an optimum number of couplers.

U.S. Pat. No. 5,501,604 describes a multi-coupler electromechanical transfer unit design which uses a set of planetary gears to couple a set of planetary rolling preloaded couplers with the rings. In this configuration, the contact rings are coupled to the sun and ring gears of the planetary set. This configuration has the advantage of allowing the use of a greater number of couplers to satisfy a greater transfer current requirement without requiring the use of a full complement. The addition of gearing, however, increases the fabrication cost and decreases the life because of gear wear and the complexity of trying to use a lubricant for the gearing without contaminating the electrical interfaces. In addition, since the couplers ride on a thin compliant tubular carrier which is common to the planet gears, the allowable deflections and misalignments are not as great as that of the early configurations of multi-flexure arrangements such as described in U.S. Pat. Nos. 4,068,909 and 4,372,633.

Designs to date have utilized a rigid conductive ring with a spherical contact (radius in two dimensions) on both the rotor (rotating side) and the stator (stationary side) side of the interface and one or more rigid couplers geometrically sized with the appropriate spherical geometry for the given set of rings. In the past, generating the required preload to maintain contact has been accomplished by fitting two coupler halves facing in the opposite direction onto a common axle, and fitting a compression spring between the two, generating the outward (or inward in the case of a rail geometry in lieu of a groove in the conductive rings) force needed to maintain contact. Further development of this style coupler has also been achieved by mounting several such couplers to an external nonflexible frame to allow for mounting several couplers onto the same channel while maintaining the consistent interval between the couplers. However, the continued outward force generated has negatively impacted rotation of the coupler halves. Problems with these designs after a period of operation, include: uncoiling of the spring (typically the source of the outward force generated), disassembly of the axle assembly, and excessive wear of the coupler at the interface with the axle.

Thus, a heretofore unaddressed need exists in the industry to address the aforementioned deficiencies and inadequacies.

SUMMARY OF THE DISCLOSURE

Embodiments of the present disclosure provide a system and method for a full-rotational conductor assembly. Briefly described, in architecture, one embodiment of the system, among others, can be implemented as follows. The system includes a pair of coaxial electrically conductive members having complementary tracks, relatively rotatable about a common axis. A plurality of electrically conductive coupler halves located between and engaging the tracks enable electrical connection between the tracks of the conductive members. A cage is connected to each of the coupler halves and substantially located between the complimentary tracks.

The present disclosure can also be viewed as providing methods for accomplishing electronic transfer between relatively rotating elements. In this regard, one embodiment of such a method, among others, can be broadly summarized by the following steps: mounting a plurality of electrically conductive coupler halves between and engaging the complimentary tracks, thereby enabling electrical connection between the tracks of the conductive members; mounting each of the coupler halves to a cage substantially located between the complimentary tracks; and maintaining the coupler halves in spaced relationship along a circumference of the tracks with the cage.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
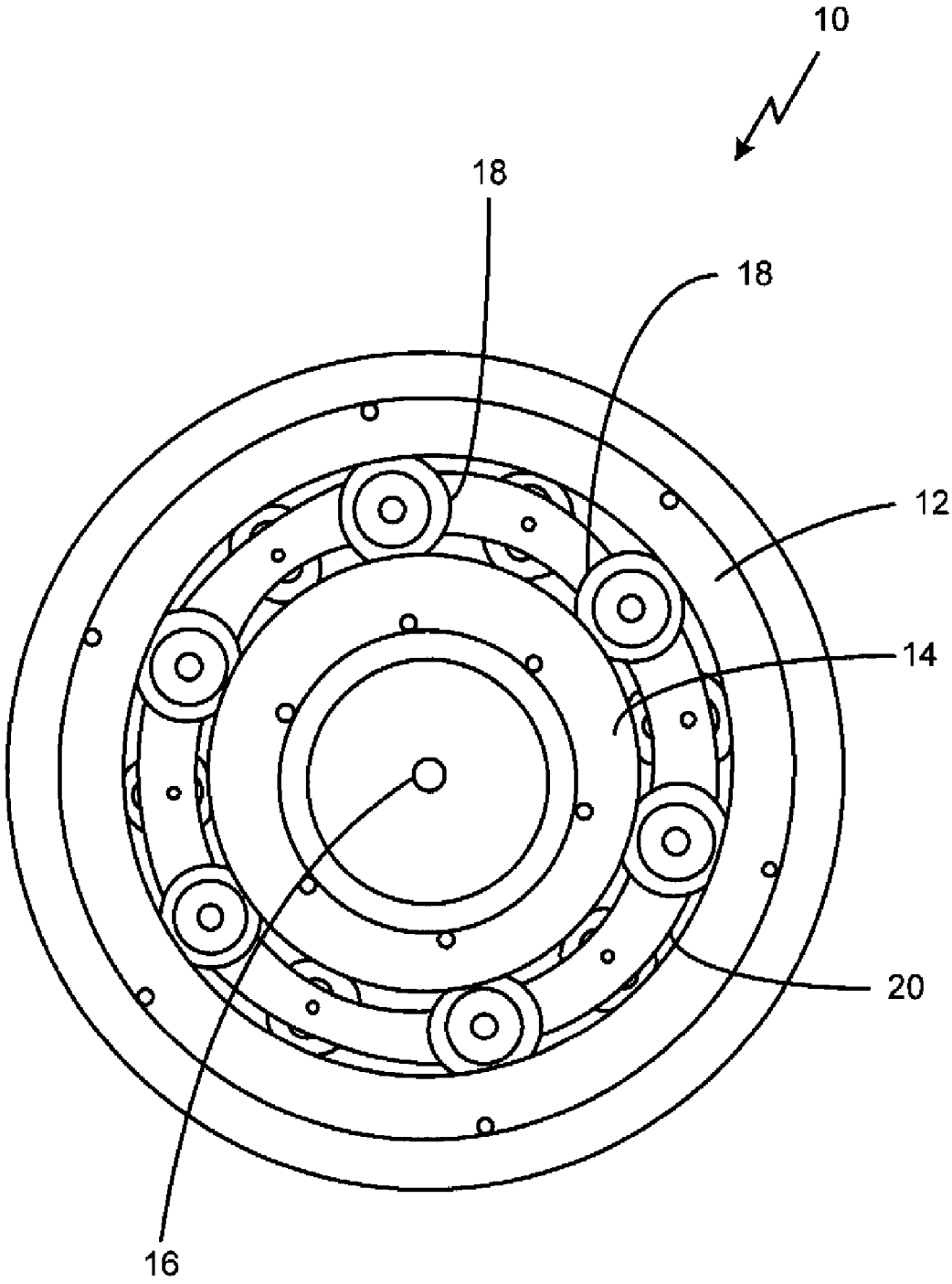
FIG. 1 is an illustration of a perspective view of a full-rotational conductor assembly, in accordance with a first exemplary embodiment of the present disclosure.

FIG. 1 is an illustration of a top view of a full-rotational conductor assembly 10, in accordance with the first exemplary embodiment of the present disclosure. The full-rotational conductor assembly 10 includes a pair of coaxial electrically conductive members 12, 14 having complementary tracks, relatively rotatable about a common axis 16. A plurality of electrically conductive coupler halves 18 located between and engaging the tracks of the conductive members 12, 14 enable electrical connection between the conductive members 12, 14. A cage 20 is connected to each of the coupler halves and substantially located between the complimentary tracks.

Figure 2:
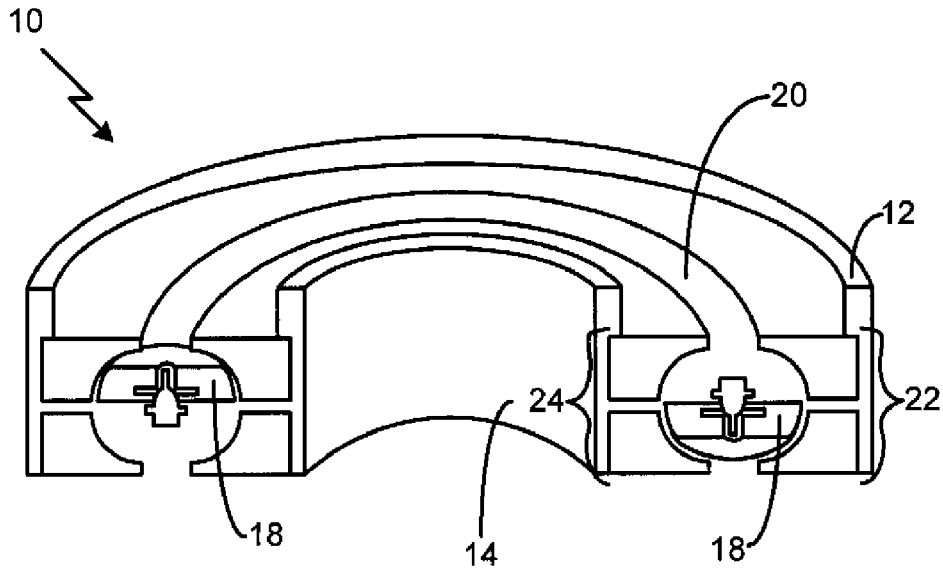
FIG. 2 is an illustration of a sectional perspective view of the full-rotational conductor assembly of FIG. 1, in accordance with the first exemplary embodiment of the present disclosure.

FIG. 2 is an illustration of a sectional perspective view of the full-rotational conductor assembly 10 of FIG. 1, in accordance with the first exemplary embodiment of the present disclosure. As can be seen in FIG. 2, an outer coaxial electrically conductive member 12 has a first complementary track 22 and an inner coaxial electrically conductive member 14 has a second complementary track 24. Connecting the complementary tracks 24 is the plurality of coupler halves 18. Also, as can be seen in FIG. 2, the coupler halves 18 may each be isolated from the other coupler halves 18 by the cage 20, which maintains their separation.

Figure 3:
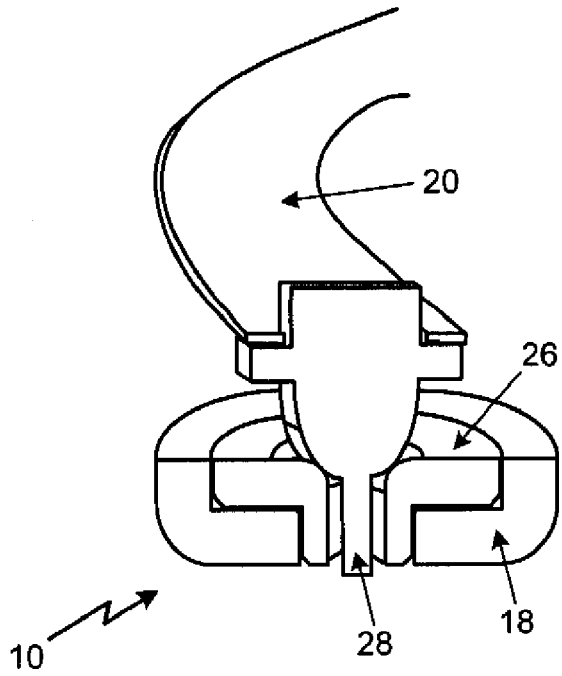
FIG. 3 is an illustration of a sectional perspective view of a portion of the full-rotational conductor assembly of FIG. 1, in accordance with the first exemplary embodiment of the present disclosure.

FIG. 3 is an illustration of a sectional perspective view of a portion of the full-rotational conductor assembly 10 of FIG. 1, in accordance with the first exemplary embodiment of the present disclosure. FIG. 3 illustrates one contemplated connection arrangement between the coupler halves 18 and the cage 20. The coupler halves 18 may each contain a bushing 26 mounted therein. The bushing 26 may receive an axle 28 connected to the cage 20. The connection may be arranged so that the bushing 26 has a spherical contact where it abuts the axle 28. The bushing 26 may be made of an anti-friction, low-wear plastic, such as Delrin or Teflon. The axle 28 that the bushing 26 rides on may have a similar spherical contact surface. The meeting spherical contact surface may minimize contact area and reduce frictional forces between the non-rotating axle 28, and the coupler half 18. The spherical contact between the bushing 26 and the axle 28 may allow the same degrees of freedom as a standard ball in socket joint which may allow the coupler halves 18 to conform to the grooves to overcome any manufacturing tolerances.

Figure 4:
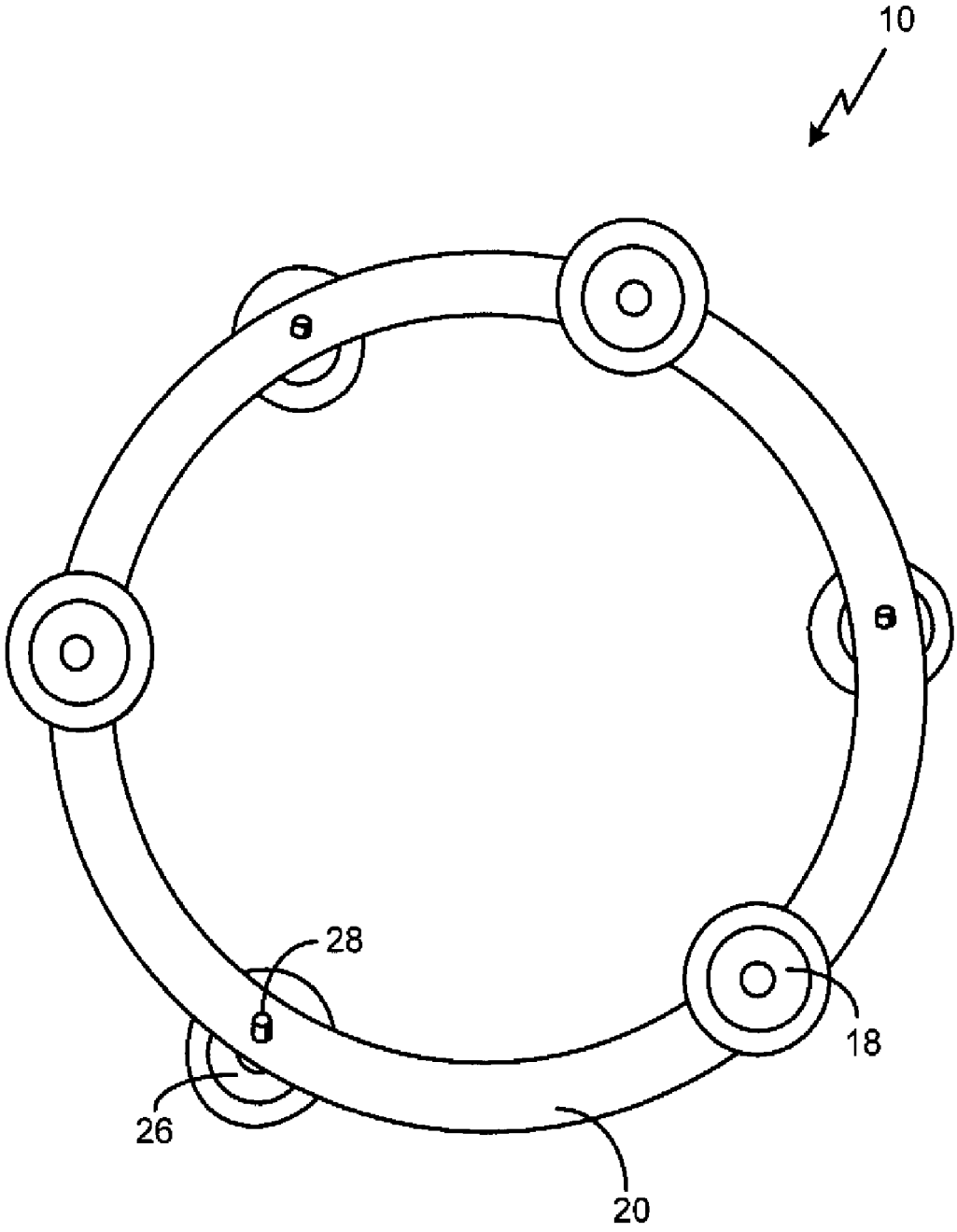
FIG. 4 is an illustration of a perspective view of a portion of the full-rotational conductor assembly of FIG. 1, in accordance with the first exemplary embodiment of the present disclosure.
Figure 5:
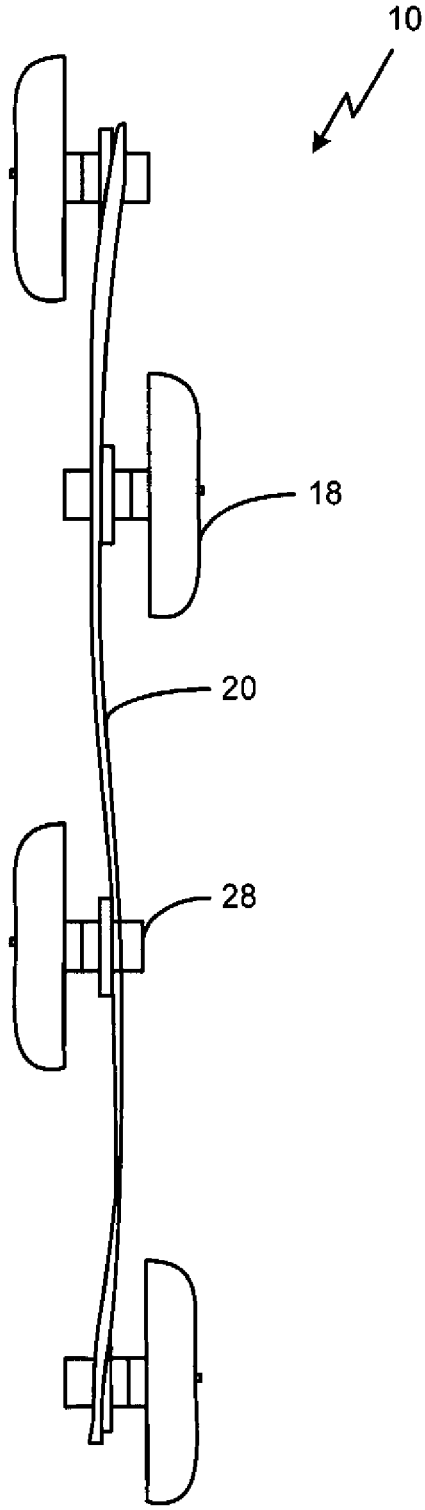
FIG. 5 is an illustration of a side view of a portion of the full-rotational conductor assembly of FIG. 1, in accordance with the first exemplary embodiment of the present disclosure.

FIG. 4 is an illustration of a perspective view of a portion of the full-rotational conductor assembly 10 of FIG. 1, in accordance with the first exemplary embodiment of the present disclosure. FIG. 5 is an illustration of a side view of a portion of the full-rotational conductor assembly 10 of FIG. 1, in accordance with the first exemplary embodiment of the present disclosure. As shown in FIG. 4, the individual coupler halves 18 may be equally spaced, with each coupler half 18 facing in the opposite direction as the two adjacent halves 18. This arrangement requires an even number of coupler halves 18 for the full coupler compliment for a given channel. Knowing the geometry of the coupler halves 18 and the rings, the axle 28 may be designed to have a sufficient length such that when the full channel is assembled, the cage 20 is deflected, and the force results from the tension of the cage 20 material. The cage 20 may be made of material selected based on its modulus of elasticity. FIG. 5 illustrates an exemplary level of deflection in the cage 20 (although the impetus for the deflection is not shown).

Figure 6:
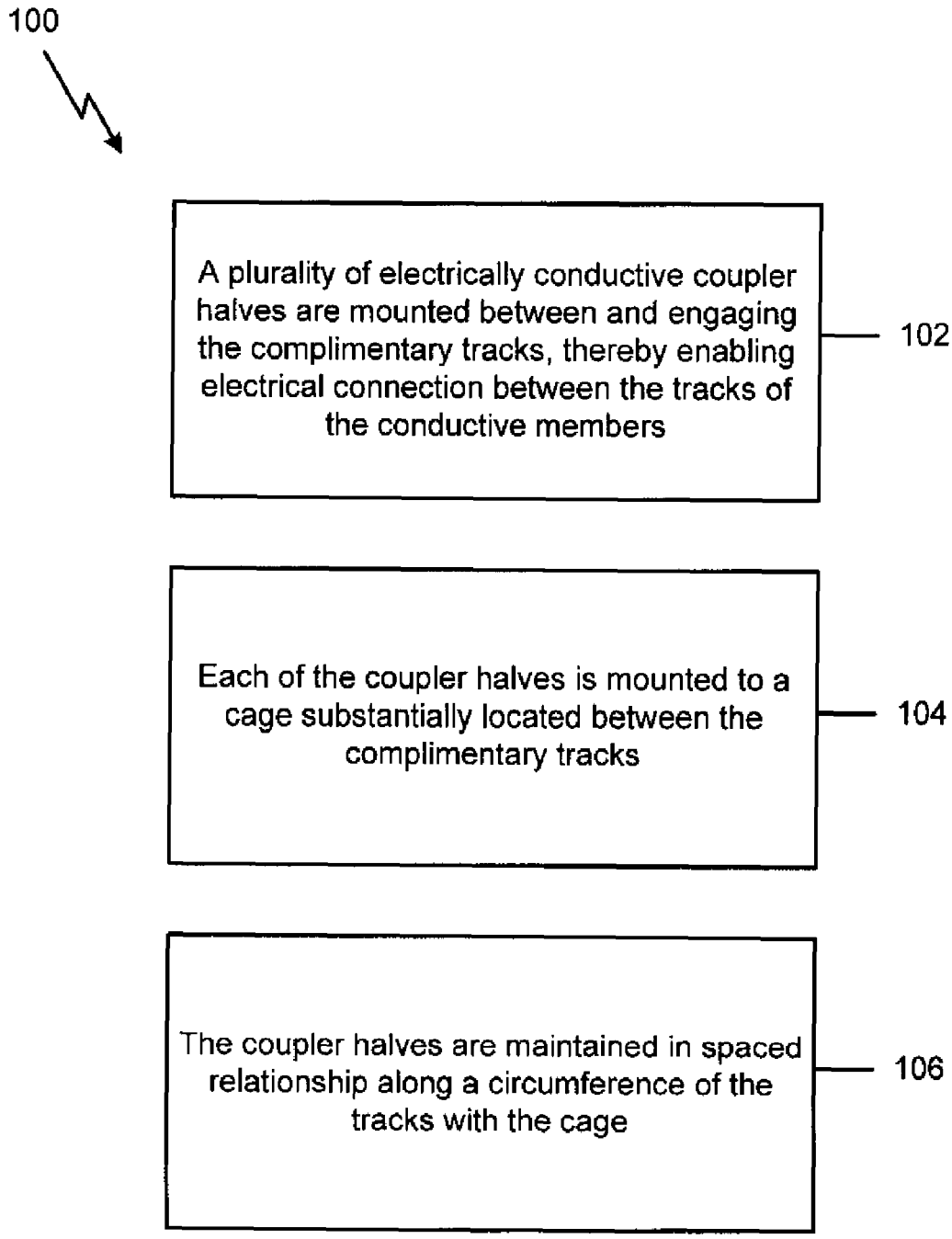
FIG. 6 is an illustration of a flow chart providing one possible implementation of the full-rotational conductor assembly of FIG. 1, in accordance with the first exemplary embodiment of the present disclosure.

FIG. 6 is an illustration of a flow chart 100 providing one possible implementation of the full-rotational conductor assembly 10 of FIG. 1, in accordance with the first exemplary embodiment of the present disclosure. In this regard, each block represents a module, segment, or step, which comprises one or more executable instructions for implementing the specified logical function. It should also be noted that in some alternative implementations, the functions noted in the blocks might occur out of the order noted in FIG. 6. For example, two blocks shown in succession in FIG. 6 may in fact be executed substantially concurrently or the blocks may sometimes be executed in the reverse order, depending upon the functionality involved, as will be further clarified herein.

The present disclosure includes a method 100 for conducting electricity between two coaxial electrically conductive members 12, 14 having complementary tracks, relatively rotatable about a common axis 16. A plurality of electrically conductive coupler halves 18 are mounted between and engaging the complimentary tracks, thereby enabling electrical connection between the tracks of the conductive members 12, 14 (block 102). Each of the coupler halves 18 is mounted to a cage 20 substantially located between the complimentary tracks (block 104). The coupler halves 18 are maintained in spaced relationship along a circumference of the tracks with the cage 20 (block 106).

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment of the disclosure without departing substantially from the spirit and principles of the disclosure. All such modifications and variations are intended to be included herein within the scope of this disclosure and the present disclosure and protected by the following claims.

What is claimed is:

1. A full-rotational conductor assembly, comprising:

a pair of coaxial electrically conductive members having complementary tracks, relatively rotatable about a common axis;

a plurality of electrically conductive coupler halves, each of the coupler halves located between and engaging the tracks, thereby enabling electrical connection between the tracks of the conductive members; and a cage connected to each of the coupler halves and substantially located between the complimentary tracks, wherein the cage biases the coupler halves against the complimentary tracks.

2. The full-rotational conductor assembly of claim 1, wherein each of the coupler halves is isolated from the other coupler halves.

3. The full-rotational conductor assembly of claim 1, further comprising a bushing mounted within each of the coupler halves for receiving a connector from the cage.

4. The full-rotational conductor assembly of claim 1, further comprising a plurality of axles connecting the cage to each of the coupler halves.

5. The full-rotational conductor assembly of claim 1, wherein the cage further comprises a first side and a second side, wherein at least one of the coupler halves is mounted to the first side of the cage and at least one of the coupler halves is mounted to the second side of the cage.

6. The full-rotational conductor assembly of claim 1, wherein the pair of coaxial electrically conductive members further comprises an inner conductive member and an outer conductive member, wherein the cage is located within the outer conductive member.

7. The full-rotational conductor assembly of claim 3, wherein the bushing has diminished frictional contact with the connector.

8. A full-rotational conductor assembly, comprising:

a pair of coaxial electrically conductive members having complementary tracks, relatively rotatable about a common axis;

a plurality of electrically conductive coupler halves, each of the coupler halves located between and engaging the tracks, thereby enabling electrical connection between the tracks of the conductive members;

a plurality of bushings, wherein each of the coupler halves has one of the bushings mounted therein, wherein the bushing and coupler halves are formed from different materials;

a plurality of axles, wherein each of the bushings is engaged with one of the axles; and a cage substantially located between the complimentary tracks and connected to each of the axles.

9. The full-rotational conductor assembly of claim 8, wherein each of the coupler halves is isolated from the other coupler halves.

10. The full rotational conductor assembly of claim 8, wherein the cage biases the coupler halves against the complimentary tracks.

11. The full-rotational conductor assembly of claim 8, wherein the bushing has diminished frictional contact with the axle.

12. The full-rotational conductor assembly of claim 8, wherein the cage further comprises a first side and a second side, wherein at least one of the coupler halves is mounted to the first side of the cage and at least one of the coupler halves is mounted to the second side of the cage.

13. A method of conducting electricity between two coaxial electrically conductive members having complementary tracks, relatively rotatable about a common axis, the method comprising the steps of:

mounting a plurality of electrically conductive coupler halves between and engaging the complimentary tracks, thereby enabling electrical connection between the tracks of the conductive members;

mounting each of the coupler halves to a cage substantially located between the complimentary tracks;

maintaining the coupler halves in spaced relationship along a circumference of the tracks with the cage;

loading a bushing into each of the coupler halves;

mounting a plurality of axles to the cage; and engaging the axles with the bushings.

14. The method of claim 13, further comprising diminishing frictional contact between the axle and the bushing.

15. The method of claim 13, further comprising the step of biasing the coupler halves into the tracks with the cage.

16. The method of claim 13, wherein the step of mounting a plurality of electrically conductive coupler halves further comprises mounting two of the coupler halves to each of opposing sides of the cage.

* * * * *